US010120398B2

(12) United States Patent
Illing et al.

(10) Patent No.: US 10,120,398 B2
(45) Date of Patent: Nov. 6, 2018

(54) TEMPERATURE DEPENDENT CURRENT LIMITING

(71) Applicant: Infineon Technologies AG, Neubiberg (DE)

(72) Inventors: Robert Illing, Villach (AT); Alexander Mayer, Treffen (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 14/229,201

(22) Filed: Mar. 28, 2014

(65) Prior Publication Data

US 2015/0277456 A1 Oct. 1, 2015

(51) Int. Cl.
*G05F 1/10* (2006.01)

(52) U.S. Cl.
CPC ..... *G05F 1/10* (2013.01)

(58) Field of Classification Search
CPC ..... G05F 1/10
See application file for complete search history.

(56) References Cited

U.S. PATENT DOCUMENTS 5,519,341 A 5/1996 Corsi et al.
5,635,823 A 6/1997 Murakami et al.
6,982,528 B2 1/2006 Cottongim et al.
2005/0099142 A1* 5/2005 Cottongim ..... H05B 41/2856 315/309
2006/0255751 A1* 11/2006 Chitta ..... H05B 41/2986 315/309
2007/0076342 A1* 4/2007 Arndt ..... 361/103
2010/0244800 A1* 9/2010 Nakamura ..... H02M 1/32 323/284
2011/0181263 A1* 7/2011 Maruyama ..... H03K 17/0828 323/284

FOREIGN PATENT DOCUMENTS

CN 101165985 A 4/2008
CN 103135646 A 6/2013
JP H08111524 A 4/1996
JP 2009089121 A 4/2009

* cited by examiner

*Primary Examiner* — Jue Zhang
(74) *Attorney, Agent, or Firm* — Shumaker & Sieffert, P.A.

(57) ABSTRACT

In one example, a method includes determining, by a temperature sensor, a temperature of a device that controls an amount of current flowing to a load, and determining, based on the temperature of the device, a threshold current. The method also includes, in response to determining that the amount of current flowing to the load is greater than the threshold current, adjusting the amount of current flowing to the load.

15 Claims, 8 Drawing Sheets

TEMPERATURE DEPENDENT CURRENT LIMITING

TECHNICAL FIELD

This disclosure relates to techniques for limiting electrical current, and in particular, to techniques for limiting electrical current based on temperature.

BACKGROUND

Current limiting techniques may be used as a protective function for power supplying devices, such as power transistors, in order to protect the devices from damage in the event of overload (for example short circuit). Generally, an overload occurs when the current provided by the device exceeds a threshold current. In some examples, it may be desirable to select a threshold current that is as low as possible in order to reduce the time required to detect an overload. In some examples, it may be desirable to selected a threshold current that is as high as possible so as the enable the power supply device to drive a larger load.

SUMMARY

In general, this disclosure is directed to techniques for limiting the amount of current provided to a load based on a temperature of a device that controls the amount of current provided to the load. The techniques may be implemented by one or more devices or systems. For instance, a system may include a semiconductor device which may be used to control the amount of current provided to a load, and a temperature sensor which may be integrated into the semiconductor device or may be positioned near the semiconductor device. The system may also include one or more components configured to determine, based on the temperature measured by the temperature sensor, a threshold current, and one or more components configured to determine the amount of current provided by the semiconductor device. Responsive to determining that the current provided to the load is greater than the threshold current, the semiconductor device may adjust the amount of current flowing to the load. Therefore, rather than using a constant threshold current, techniques of this disclosure may enable the system to use a dynamic threshold current determined based at least on the temperature of the semiconductor device.

In one example, a method includes determining, by a temperature sensor, a temperature of a device that controls an amount of current flowing to a load; determining, based on the temperature of the device, a threshold current; and in response to determining that the amount of current flowing to the load is greater than the threshold current, adjusting the amount of current flowing to the load.

In another example, a system includes a device configured to control an amount of current flowing to a load; a temperature module configured to determine a temperature of the device; a threshold current module configured to determine, based on the temperature of the device, a threshold current; and a current control module configured to adjust the amount of current flowing to the load responsive to determining that the amount of current flowing to the load is greater than the threshold current.

In yet another example, a system includes means for controlling an amount of current flowing to a load; means for determining a temperature of the means for controlling; means for determining, based on the temperature of the means for controlling, a threshold current; and means for adjusting the amount of current flowing to the load responsive to determining that the amount of current flowing to the load is greater than the threshold current.

The details of one or more examples of the disclosure are set forth in the accompanying drawings and the description below. Other features, objects, and advantages will be apparent from the description and drawings, and from the claims.

DETAILED DESCRIPTION

Figure 1:
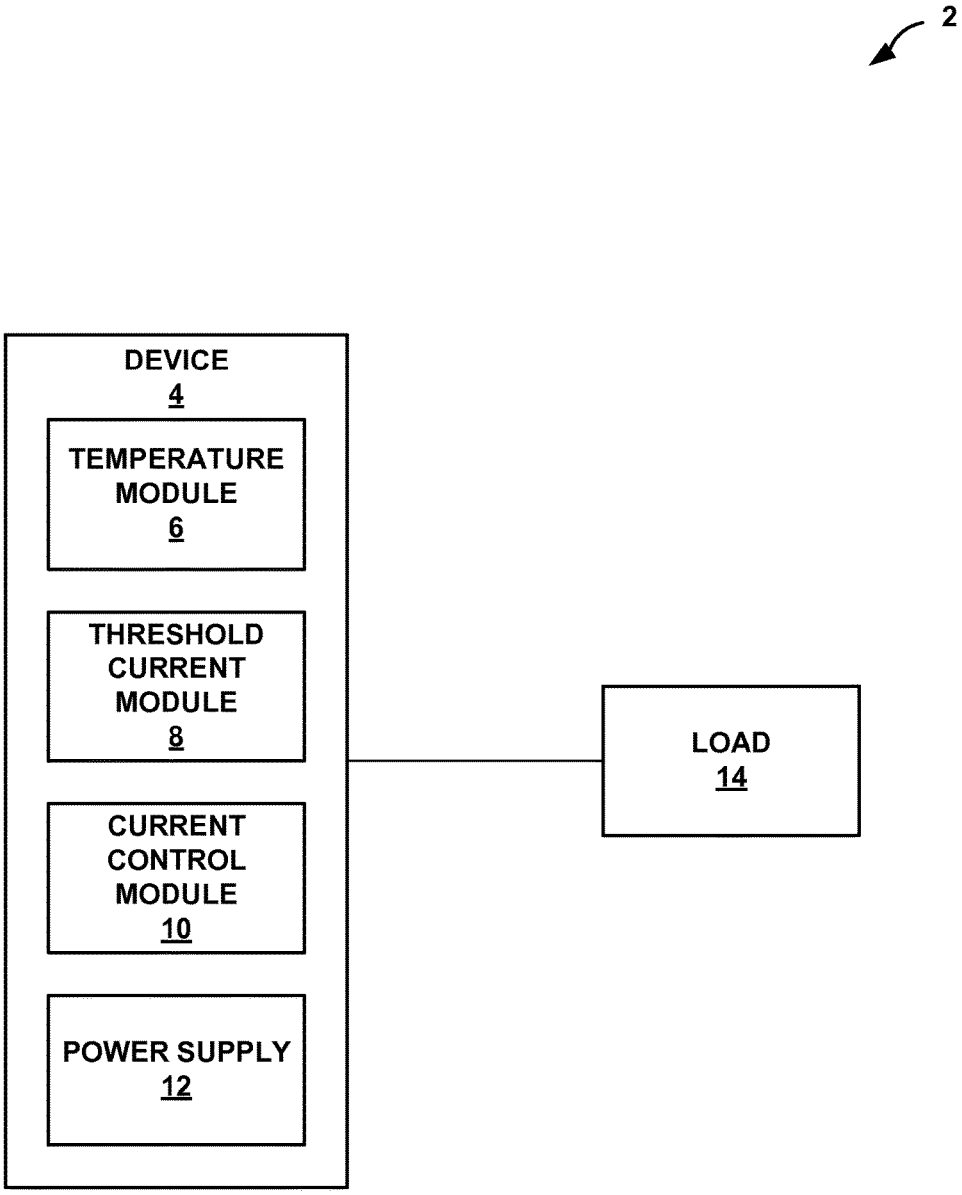
FIG. 1 is a conceptual diagram of an example system for limiting the amount of current provided to a load, in accordance with one or more techniques of this disclosure.

In general, this disclosure is directed to techniques for limiting the amount of current provided to a load based on a temperature of a device that controls the amount of current provided to the load. The techniques may be implemented by one or more devices or systems. For instance, a system may include a semiconductor device which may be used to control the amount of current provided to a load, and a temperature sensor which may be integrated into the semiconductor device or may be positioned near the semiconductor device. The system may also include one or more components configured to determine, based on the temperature measured by the temperature sensor, a threshold current, and one or more components configured to determine the amount of current provided by the semiconductor device. Responsive to determining that the current provided to the load is greater than the threshold current, the semiconductor device may adjust the amount of current flowing to the load. Therefore, rather than using a constant threshold current, techniques of this disclosure may enable the system to use a dynamic threshold current determined based at least on the temperature of the semiconductor device.

Current limiting may be used as a protective function for devices, such as power transistors, in order to protect the devices from damage in the event of overload (for example short circuit). As a result of the increasing miniaturization of semiconductor devices (i.e., the reduction of the $R_{on}$×Area) and improvement of the response times during a short-circuit cycle, the short-circuit pulses may become ever shorter. Generally, the power loss or energy component during deactivation may be determined by the current (I) and the inductance (L). For instance, the energy during deactivation may be determined in accordance with equation (1), below.

$$E = \frac{1}{2}LI^2 \quad (1)$$

The inductive component in the load circuit may be application-specific. Therefore, in contrast to the current, it may be more difficult to adjust the inductive component. In some examples, it may be desirable to select a threshold current that is as low as possible in order to reduce the time required to detect an overload. For instance, in order to improve the short-circuit robustness of a device in the form of an increased short-circuit cycle number, it may be desirable to select a threshold current that is as low as possible. In this way, a device may absorb less energy during deactivation and is thus able to endure a greater number of short-circuit cycles before failure.

In some examples, it may be desirable to select a threshold current that is as high as possible so as the enable the power supply device to drive a larger load. For instance, in order to enable a single device to drive multiple loads (and reduce the need for additional devices), it may be desirable to select a threshold current that is as high as possible. Accordingly, the current value may be the result of a compromise between maximum-switchable load and short-circuit cycle number.

FIG. 1 is a conceptual diagram illustrating an example system 2 for limiting the amount of current provided to a load, in accordance with one or more techniques of this disclosure. As illustrated in FIG. 1, system 2 includes device 4 and load 14.

System 2, in some examples, includes device 4 which may be configured to control the amount of current provided to load 14. In some examples, device 4 includes temperature module 6, threshold current module 8, current control module 10, and power supply 12.

In some examples, device 4 may include temperature module 6 which may be configured to determine a temperature. For instance temperature module 6 may be configured to determine the temperature of power supply 12. In some examples, temperature module 6 may be configured to provide the determined temperature to one or more other components of device 4, such as threshold current module 8. In some examples, temperature module 6 may include one or more temperature sensors. Examples of temperature sensors which may be included in temperature module 6 include, but are not limited to, bipolar transistors, diodes, thermistors, thermocouples, and the like. In some examples, temperature module 6 may include a positive temperature coefficient (PTC) temperature sensor. In other words, in some examples, a characteristic of temperature module 6 may have a higher value at higher temperatures than at lower temperatures. In some examples, temperature module 6 may include a negative temperature coefficient (NTC) temperature sensor. In other words, in some examples, a characteristic of temperature sensor 6 may have a lower value at higher temperatures than at lower temperatures.

In some examples, device 4 may include threshold current module 8 which may be configured to determine a threshold current based at least in part on a temperature value. For instance, threshold current module 8 may determine a threshold current based at least in part on a temperature of power supply 12 received from temperature module 6. Examples of threshold current module 8 may include, but are not limited to, one or more processors, including, one or more microprocessors, digital signal processors (DSPs), application specific integrated circuits (ASICs), field programmable gate arrays (FPGAs), or any other equivalent integrated or discrete logic circuitry, as well as any combinations of such components. In some examples, threshold current module 8 may be configured to provide the determined threshold current to one or more other components of device 4, such as current control module 10.

In some examples, device 4 may include current control module 10 which may be configured to control the amount of current provided to load 14. In some examples, current control module 10 may be configured to determine an amount of current provided by device 4 to load 14. For instance, current control module 10 may be configured to determine an amount of current provided by power supply 12. In some examples, current control module 10 may be configured to control the amount of current provided to load 14 based at least on a threshold current received from threshold current module 8. For instance, responsive to determining that the amount of current provided to load 14 is greater than the threshold current, current control module 10 may be configured to adjust the amount of current provided to load 14. Examples of current control module 10 may include, but are not limited to, one or more processors, including, one or more microprocessors, digital signal processors (DSPs), application specific integrated circuits (ASICs), field programmable gate arrays (FPGAs), or any other equivalent integrated or discrete logic circuitry, as well as any combinations of such components.

In some examples, device 4 may include power supply 12 which may be configured to provide power to load 14. In some examples, power supply 12 may be configured to receive power from another device provide at least a portion of the received power to load 14. For instance, power supply 12 may include a switch configured to control the amount of current provided to load 14. Examples of power supply 12 may include, but are not limited to, semiconductors (e.g., power transistors), switched mode power supplies, regulated power supplies, or any other device capable of providing power to a load.

In some examples, system 2 may include load 14 which may be configured to receive power from device 4. In some examples, load 14 may include one or more light emitting devices (e.g., one or more light bulbs, one or more light emitting diodes (LEDs), one or more laser diodes, and the like), one or more batteries, one or more computing devices, one or more resistive devices, one or more capacitive devices, one or more inductive devices, any other device that uses electrical power, or any combination of the same.

In accordance with one or more techniques of this disclosure, device 4 may limit the amount of current provided to load 14 based at least in part on a temperature value. At a first time, device 4 may begin to provide power to load 14. For instance, power supply 12 may cause current to begin to flow to load 14. Upon beginning to receive power from device 4, load 14 may become energized and draw an inrush amount of current. In some examples, such as where load 14 includes one or more light emitting devices, the inrush amount of current may be greater than an amount of current drawn by load 14 in a steady state.

Temperature module 6 may determine a temperature of one or more components of device 4. For instance, one or more temperature sensors of temperature module 6 may determine a temperature of power supply 12. Temperature module 6 may provide the determined temperature of power supply 12 to threshold current module 8.

Threshold current module 8 may determine, based at least on the received temperature of power supply 12, a threshold current. In some example, threshold current module 8 may determine the threshold current with a NTC. For instance, threshold current module 8 may determine a first value for the threshold current when the temperature of power supply 12 is at a high value, and determine a second, lower, value for the threshold current when the temperature of power supply 12 is at a lower value. In some examples, threshold current module 8 may determine the threshold current based at least on the temperature of power supply 12 and an offset temperature. For instance, threshold current module 8 may determine the threshold current as constant until the temperature of power supply 12 exceeds the offset temperature. Threshold current module 8 may output the determined threshold current to current control module 10.

Current control module 10 may receive the threshold current and determine whether or not the threshold current is greater than an amount of current provided to load 14. In some examples, current control module 10 may determine the amount of current provided to load 14 by activating a sense resistor, the voltage drop across which corresponds to the amount of current provided by power supply 12. Responsive to determining that the amount of current provided to load 14 is greater than the threshold current, current control module 10 may adjust the amount of current provided to load 14. In some examples, current control module 10 may adjust the amount of current provided to load 14 by limiting the amount of current flowing to load 14 to the threshold current. In some examples, current control module 10 may adjust the amount of current provided to load 14 by deactivating load 14 (i.e., causing device 4 to provide approximately zero current to load 14). In some examples, current control module 10 may adjust the amount of current provided to load 14 by sending a signal to power supply 12 that causes power supply 12 to adjust the amount of current flowing to load 14. In this way, current control module 10 may limit the amount of current provided to device 14 based at least in part on the temperature of power supply 12. Also in this way, current control module 10 may improve the short-circuit robustness of device 4.

Figure 2:
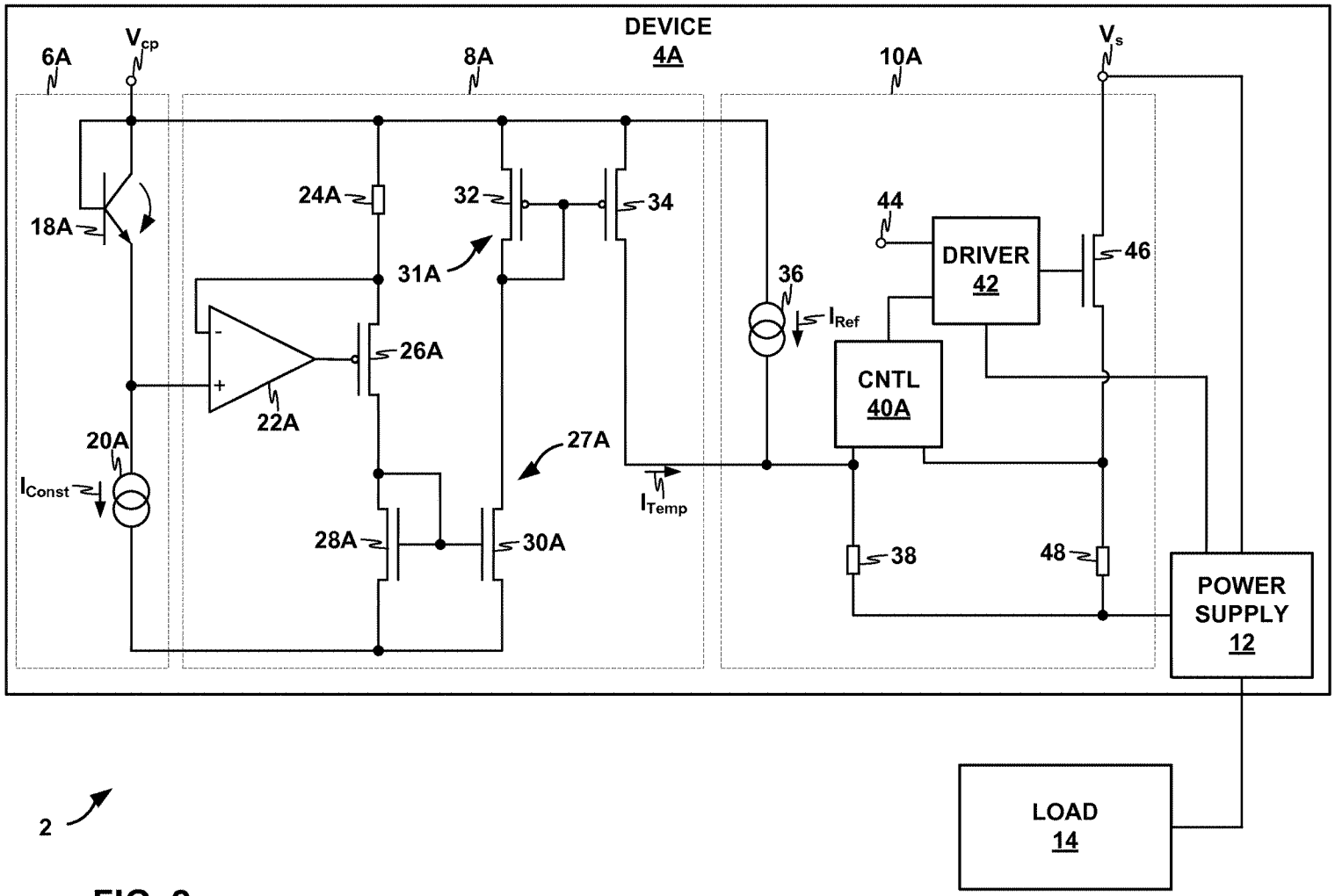
FIG. 2 is a block diagram of an example system that can limit the amount of current provided to a load, in accordance with one or more techniques of this disclosure.

FIG. 2 is a block diagram illustrating details of an example system that can limit the amount of current provided to a load, in accordance with one or more techniques of this disclosure. As illustrated in the example of FIG. 2, may include device 4A and load 14. Device 4A, as illustrated in the example of FIG. 2, may include temperature module 6A, threshold current module 8A, current control module 10A, and power supply 12.

Temperature module 6A may be configured to perform operations similar to temperature module 6 of FIG. 1. For instance, temperature module 6A may be configured to determine a temperature of one or more components of device 4A. As illustrated in FIG. 2, temperature module 6A may include temperature sensor 18A and current source 20A.

In some examples, temperature module 6A may include temperature sensor 18A which may be configured to measure a temperature. For instance, temperature sensor 18A may be configured to measure the temperature of power supply 12. As discussed above, temperature module 6A may have either a NTC or a PTC. As such, temperature sensor 18A may have either a NTC or a PTC. In some examples, temperature sensor 18A may be a semiconductor device, such as a bipolar transistor, a resistor (i.e., a poly resistor, a diffusion resistor, a metal resistor, or a thermistor), or a diode. Also as discussed above, the voltage drop across temperature sensor 18A may correspond to the measured temperature.

In some examples, temperature module 6A may include current source 20A which may be configured to output a current. In some examples, current source 20A may be a constant current source which may output constant current ($I_{Cons}$). In some examples, current source 20A may be a temperature-independent constant current source which may output constant current ($I_{Cons}$) regardless of the temperature of current source 20A. In some examples, current source 20A may be configured to bias temperature sensor 18A with a constant current.

Threshold current module 8A may be configured to perform operations similar to threshold current module 8A of FIG. 1. For instance, threshold current module 8A may be configured to determine, based at least on the temperature received from temperature module 6A, a threshold current. As illustrated in FIG. 2, threshold current module 8A may include amplifier 22A, resistor 24A, transistor 26A, first current mirror 27A, and second current mirror 31A.

In some examples, threshold current module 8A may include amplifier 22A, resistor 24A, and transistor 26A which may be configured to convert the voltage drop across temperature sensor 18A into a current. In some examples, transistor 26A may be a p-type transistor (e.g., a PMOS transistor). In some examples, transistor 26A may be an n-type transistor (e.g., an NMOS transistor). In some examples, amplifier 22A, resistor 24A, and transistor 26A may provide the current to one or more other components of device 4A, such as first current mirror 27A.

In some examples, threshold current module 8A may include first current mirror 27A which may be configured to receive a first current and output a second current that corresponds to the first current. In some examples, first current mirror 27A may include transistor 28A and transistor 30A. In some examples, transistor 28A and transistor 30A may be n-type transistors (e.g., NMOS transistors). In some examples, transistor 28A and transistor 30A may be p-type transistors (e.g., PMOS transistors). In some examples, first current mirror 27A may be configured to output the second current (that corresponds to the first current) to one or more other components of device 4A, such as second current mirror 31A.

In some examples, threshold current module 8A may include second current mirror 31A which may be configured to receive a first current and output a second current that corresponds to the first current. In some examples, second current mirror 31A may include transistor 32 and transistor 34. In some examples, transistor 32 and transistor 34 may be n-type transistors (e.g., NMOS transistors). In some examples, transistor 32 and transistor 34 may be p-type transistors (e.g., PMOS transistors). In some examples, second current mirror 31A may be configured to output the second current (that corresponds to the first current) to one or more other components of device 4A, such as resistor 38 of current control module 10.

Current control module 10A may be configured to perform operations similar to current control module 10 of FIG. 1. For instance, control current module 10A may be configured to control the amount of current provided to load 14. As illustrated in FIG. 2, current control module 10A may include current source 36, resistor 38, controller 40A, driver 42, input 44, transistor 46, and resistor 48.

In some examples, current control module 10A may include current source 36 which may be configured to output a current. In some examples, current source 36 may be a reference current source which may output reference current ($I_{Ref}$). In some examples, current source 36 may be configured to output the reference current to one or more other components of device 4A, such as resistor 38.

In some examples, current control module 10A may include resistor 38 which may be configured to generate a voltage drop based on one or more currents. For instance, resistor 38 may be configured to generate a voltage drop that corresponds to a threshold current received from threshold current module 8A (i.e., $I_{Temp}$) and a reference current received from current source 36 (i.e., $I_{Ref}$).

In some examples, current control module 10A may include controller 40A which may be configured to determine a signal based on a first voltage and a second voltage. In some examples, the first voltage may be the voltage across resistor 38 and the second voltage may be the voltage across resistor 48. In some examples, controller 40A may be configured to output the determined signal to driver 42. In some examples, controller 40A may be a comparator. For instance, where the second voltage is greater than the first voltage (i.e., where the current provided by power supply 12 is less than the threshold current), controller 40A may be configured to output a signal to driver 42 that causes driver 42 to continue to drive power supply 12 without change. Alternatively, in such examples, where the first voltage is greater than the second voltage (i.e., where the threshold current is greater than the current provided by power supply 12), controller 40A may be configured to output a signal to driver 42 that causes driver 42 to deactivate power supply 12.

In some examples, controller 40A may be a regulator. For instance, where the second voltage is greater than the first voltage (i.e., where the current provided by power supply 12 is less than the threshold current), controller 40A may be configured to output a signal to driver 42 that causes driver 42 to continue to drive power supply 12 without change. Alternatively, in such examples, where the first voltage is greater than the second voltage (i.e., where the threshold current is greater than the current provided by power supply 12), controller 40A may be configured to output a signal to driver 42 that causes driver 42 to reduce the amount of current by power supply 12.

In some examples, current control module 10A may include driver 42 which may be configured to operate one or more components of device 4A. For instance, driver 42 may be configured to output a signal to power supply 12 that causes power supply 12 to provide power to load 14. In some examples, driver 42 may be configured to output a signal to transistor 46 that causes transistor 46 to switch "on."

In some examples, current control module 10A may include input 44 which may be configured to receive a signal. In some examples, the signal received at input 44 may be an "enable" signal which may be configured to cause driver 42 to activate/deactivate power supply 12 and/or transistor 46.

In some examples, current control module 10A may include transistor 46 which may be configured to switch a current. For instance, in an "on" state, transistor 46 may be configured to allow current to flow through resistor 48. In some examples, the current switched by transistor 46 may correspond to the current provided by power supply 12 to load 14.

In some examples, current control module 10A may include resistor 48 which may be configured to generate a voltage drop based on one or more currents. For instance, resistor 48 may be configured to generate a voltage drop that corresponds to a current provided by power supply 12 to load 14. In other words, resistor 48 may be a sense resistor.

Power supply 12 may be configured to perform operations similar to current control module 10 of FIG. 1. For instance, power supply 12 may be configured to provide power to load 14. In some examples, the amount of power provided by power supply 12 may be based on a signal received from driver 42. In some examples, power supply 12 may include one or more power dissipating devices, such as one or more semiconductor devices. For instance, power supply 12 may include one or more power transistors, one or more metal-oxide-semiconductor field-effect transistors (MOSFETs), one or more thyristors, one or more insulated-gate bipolar transistors (IGBTs), and/or a combination of the same. Some example MOSFETs that may be included in power supply 12 include, but are not limited to, one or more double-diffused metal-oxide-semiconductor (DMOS) MOSFETs, one or more P-substrate (PMOS) MOSFETs, one or more trench (UMOS) MOSFETS, and one or more super-junction deep-trench MOSFETs (e.g., one or more CoolMOS™ MOSFETs).

In accordance with one or more techniques of this disclosure, device 4A may limit the amount of current provided to load 14 based at least in part on a temperature value. At a first time, in response to receiving a signal, via input 44, driver 42 may output a signal to power supply 12 that causes power supply 12 to provide current to load 14. Upon beginning to receive power from power supply 12, load 14 may become energized and draw an inrush amount of current. In some examples, such as where load 14 includes one or more light emitting devices, the inrush amount of current may be greater than an amount of current drawn by load 14 in a steady state. Additionally, as a result of providing power to load 14, the temperature of power supply 12 may begin to increase.

This temperature increase may be measured by temperature sensor 18A of temperature module 6A. For instance, temperature sensor 18A may convert the temperature of power supply 12 into a voltage signal. As discussed above, temperature sensor 18A may have a PTC or an NTC. In the example of FIG. 2, temperature sensor 18A may have a NTC. Also as discussed above, temperature sensor 18A may be biased with a constant current ($I_{Const}$) generated by current source 20A. In any case, temperature module 6A may output the voltage signal to threshold current module 8A.

Threshold module 8A may determine a threshold current based at least in part on the voltage signal received from temperature module 6A. For instance, as discussed above, amplifier 22A, resistor 24A, and transistor 26A may covert the voltage signal into a current. In some examples, the current may be the threshold current. In some examples, threshold current module 8A may perform further operations on the current in order to determine the threshold current. In such examples, the current determined by amplifier 22A, resistor 24A, and transistor 26A may be regarded as an intermediate threshold current. In some examples, threshold current module may include one or more current mirrors configured to mirror the intermediate threshold current to determine the threshold current. For instance, first current mirror 27A may mirror the intermediate threshold current and provide a second intermediate threshold current to second current mirror 31A. Second current mirror 31A may mirror the second intermediate threshold current to determine the threshold current. In any case, threshold current module 8A may output the threshold current ($I_{Temp}$) to current control module 10A.

Current control module 10A may receive the threshold current from threshold current module 8A and, based on the threshold current, adjust the amount of current flowing to load 14. For instance, controller 40A of current control module 10A may determine whether or not the amount of current flowing to load 14 is greater than the threshold current. In some examples, controller 40A may determine that the amount of current flowing to load 14 is greater than the threshold current if the voltage across resistor 48 is greater than the voltage across resistor 38. Responsive to determining that the amount of current flowing to load 14 is greater than the threshold current, controller 40A may output a signal to driver 42 that causes driver 42 to adjust the amount of current provided to load 14 by power supply 12. In some examples, controller 40A may output the signal to driver 42 such that driver 42 deactivates power supply 12. In this way, controller 40A may "trip" when the amount of current flowing to load 14 is greater than the threshold current. In some examples, controller 40A may output the signal to driver 42 such that driver 42 reduces the amount of power provided by power supply 12 below the threshold current. In this way, controller 40A may "regulate" when the amount of current flowing to load 14 is greater than the threshold current.

Figure 3:
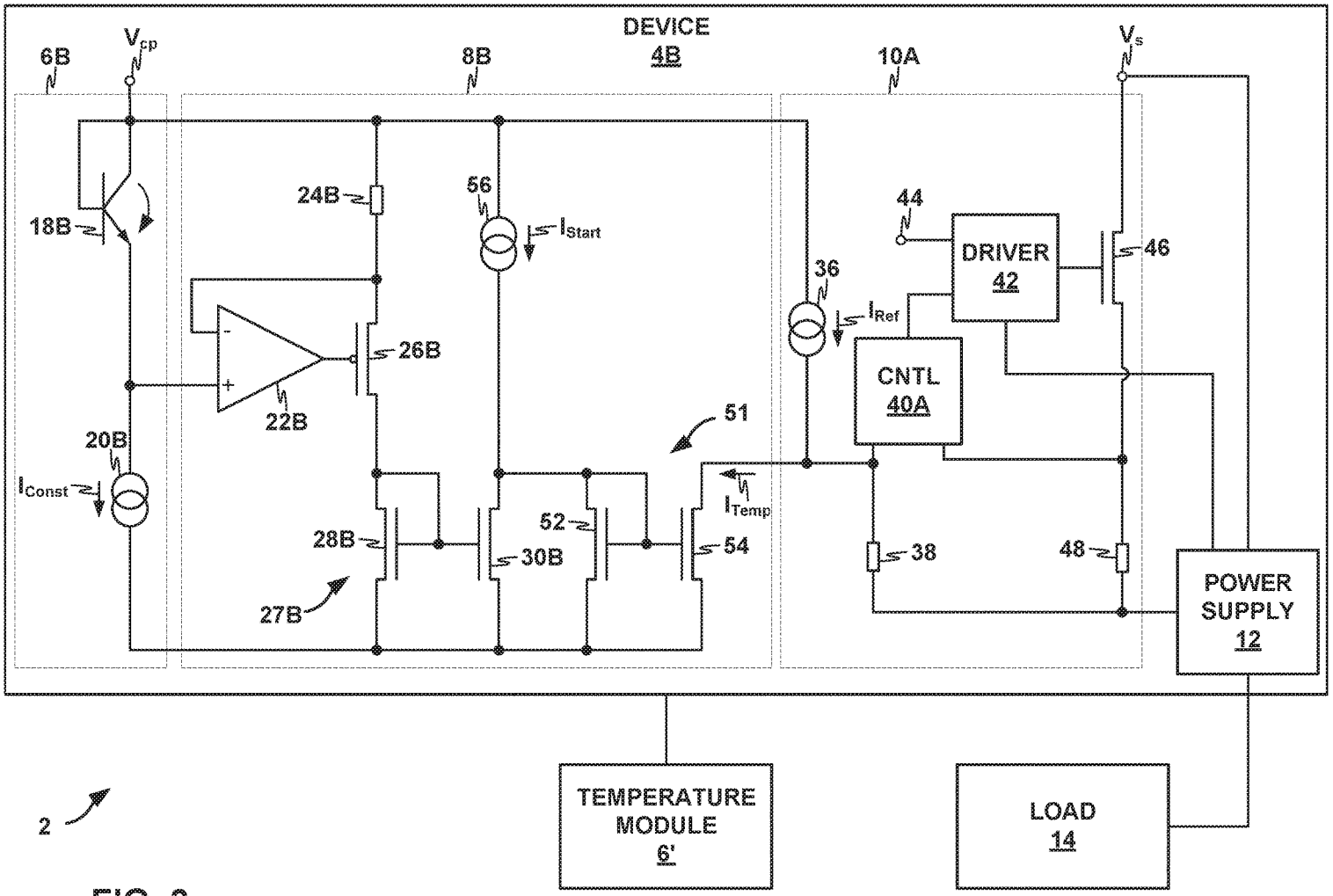
FIG. 3 is a block diagram of another example system that can limit the amount of current provided to a load, in accordance with one or more techniques of this disclosure.

FIG. 3 is a block diagram illustrating details of another example system that can limit the amount of current provided to a load, in accordance with one or more techniques of this disclosure. As illustrated in the example of FIG. 3, may include device 4B and load 14. Device 4B, as illustrated in the example of FIG. 3, may include temperature module 6B, threshold current module 8B, current control module 10A, and power supply 12.

Temperature module 6B may be configured to perform operations similar to temperature module 6 of FIG. 1. For instance, temperature module 6B may be configured to determine a temperature of one or more components of device 4B.

Threshold current module 8B may be configured to perform operations similar to threshold current module 8 of FIG. 1 and/or threshold current module 8A of FIG. 2. For instance, threshold current module 8B may be configured to determine, based at least on the temperature received from temperature module 6B, a threshold current. In some examples, threshold current module 8B may be configured to determine the threshold current based at least in part on the temperature received from temperature module 6B and a second temperature. As illustrated in the example of FIG. 3, threshold current module 8B may include amplifier 22B, resistor 24B, transistor 26B, first current mirror 27B, third current mirror 51, and current source 56. The features and functionality of amplifier 22B, resistor 24B, transistor 26B, and first current mirror 27B are similar to the functionality of amplifier 22A, resistor 24A, transistor 26A, and first current mirror 27A described above with reference to FIG. 2.

In some examples, threshold current module 8B may include current source 56 which may be configured to output a current ($I_{Start}$). In some examples, current source 56 may be configured to output the current based on a second temperature such that the amount of current flowing to load 14 is not adjusted if the temperature of power supply 12 is less than the second temperature. In some examples, the second temperature may be fixed at a predetermined value. In some examples, the predetermined value may be based on one or more characteristics of load 14. In some examples, the second temperature may be an ambient temperature which may be measured by a temperature sensor of a second temperature module, such as a temperature sensor of temperature module 6'. In some instance, the ambient temperature may be the ambient temperature to which device 4B is subjected. In other words, the ambient temperature may be ambient chip temperature.

In some examples, threshold current module 8B may include third current mirror 51 which may be configured to receive a first current and output a second current that corresponds to the first current. In some examples, third current mirror 51 may include transistor 52 and transistor 54. In some examples, transistor 52 and transistor 54 may be n-type transistors (e.g., NMOS transistors). In some examples, transistor 52 and transistor 54 may be p-type transistors (e.g., PMOS transistors). In some examples, third current mirror 51 may be configured to output the second current (that corresponds to the first current) to one or more other components of device 4B, such as resistor 38 of current control module 10A.

Current control module 10A may be configured to perform operations similar to current control module 10 of FIG. 1 and/or current control module 10A of FIG. 2. For instance, control current module 10A may be configured to control the amount of current provided to load 14.

Power supply 12 may be configured to perform operations similar to power supply 12 of FIGS. 1-2. For instance, power supply 12 may be configured to provide power to load 14 (e.g., based on a signal received from driver 42 of current control module 10A).

In accordance with one or more techniques of this disclosure, device 4B may limit the amount of current provided to load 14 based at least in part on a temperature value. At a first time, in response to receiving a signal, via input 44, driver 42 may output a signal to power supply 12 that causes power supply 12 to provide current to load 14. Upon beginning to receive power from power supply 12, load 14 may become energized and draw an inrush amount of current. In some examples, such as where load 14 includes one or more light emitting devices, the inrush amount of current may be greater than an amount of current drawn by load 14 in a steady state. Additionally, as a result of providing power to load 14, the temperature of power supply 12 may begin to increase.

This temperature increase may be measured by temperature sensor 18B of temperature module 6B. For instance, temperature sensor 18B may convert the temperature of power supply 12 into a voltage signal. As discussed above, temperature sensor 18B may have a PTC or an NTC. In the example of FIG. 3, temperature sensor 18B may have a NTC. Also as discussed above, temperature sensor 18B may be biased with a constant current ($I_{Const}$) generated by current source 20B. In any case, temperature module 6B may output the voltage signal to threshold current module 8B.

Threshold module 8B may determine a threshold current based at least in part on the voltage signal received from temperature module 6B. For instance, as discussed above, amplifier 22B, resistor 24B, and transistor 26B may convert the voltage signal into a current. In some examples, the current may be the threshold current. In some examples, threshold current module 8B may perform further operations on the current in order to determine the threshold current. In such examples, the current determined by amplifier 22B, resistor 24B, and transistor 26B may be regarded as an intermediate threshold current. In some examples, threshold current module may include one or more current mirrors configured to mirror the intermediate threshold current to determine the threshold current. For instance, first current mirror 27B may mirror the intermediate threshold current and provide a second intermediate threshold current to third current mirror 51.

Third current mirror 51 may mirror its input current to determine the threshold current. In some examples, the input current of the third current mirror may be sum of the second intermediate current output by first current mirror 27B and the current provided by current source 56 (i.e., $I_{Start}$). As discussed above, the current provided by current source 56 may be based on the second temperature. In this way, the output current of third current mirror 51 (i.e., the threshold current), may be based on the temperature of power supply 12 and a second temperature. In any case, threshold current module 8B may output the threshold current ($I_{Temp}$) to current control module 10A.

Current control module 10A may receive the threshold current from threshold current module 8B and, based on the threshold current, adjust the amount of current flowing to load 14. As discussed above, current source 36 outputs reference current $I_{Ref}$. In some examples, such as the example of FIG. 3, the threshold current may be negative such that the current flowing through resistor 38 may be determined in accordance with equation 2, below. Further details of the operation of current control module 10A are provided above with reference to FIG. 2.

$$I_{R38}=I_{Ref}-|I_{Temp}| \quad (2)$$

Figure 4:
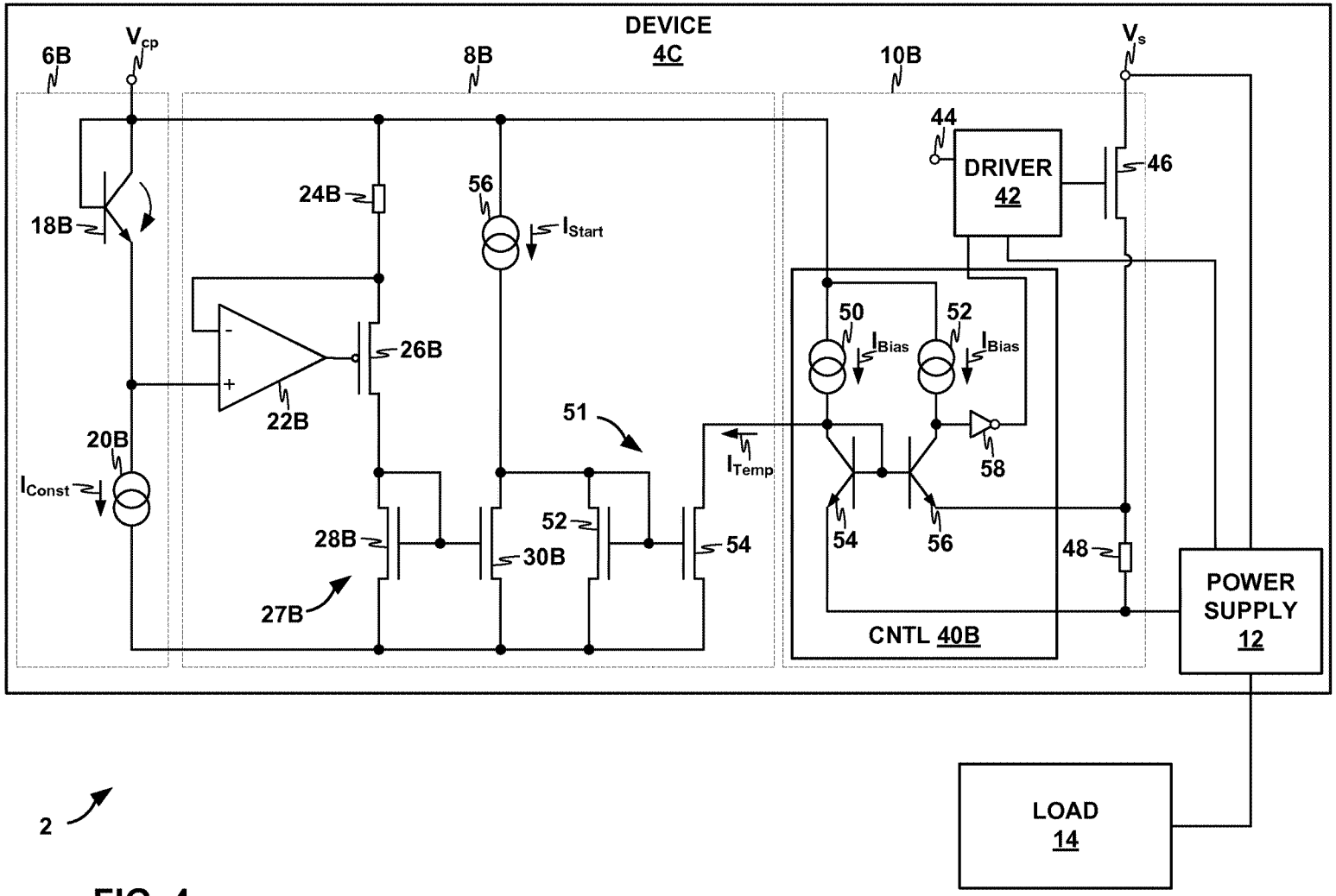
FIG. 4 is a block diagram of another example system that can limit the amount of current provided to a load, in accordance with one or more techniques of this disclosure.

FIG. 4 is a block diagram of another example system that can limit the amount of current provided to a load, in accordance with one or more techniques of this disclosure. As illustrated in the example of FIG. 4, may include device 4C and load 14. Device 4C, as illustrated in the example of FIG. 4, may include temperature module 6B, threshold current module 8B, current control module 10B, and power supply 12. The features and functionality of temperature module 6B, threshold current module 8B, and power supply 12 are discussed above with reference to FIGS. 1-3.

Current control module 10B may be configured to perform operations similar to current control module 10 of FIG. 1 and/or current control module 10A of FIGS. 2-3. For instance, control current module 10B may be configured to control the amount of current provided to load 14. As illustrated in FIG. 4, current control module 10B may include controller 40B, driver 42, input 44, transistor 46, and resistor 48. The features and functionality of driver 42, input 44, transistor 46, and resistor 48 are discussed above with reference to FIGS. 1-3.

In some examples, current control module 10B may include controller 40B which may be configured to determine a signal based on a first voltage and a second voltage. As illustrated in FIG. 4, controller 40B may include current source 50, current source 52, transistor 54, transistor 56, and inverter 58.

In some examples, controller 40B may include current source 50 which may be configured to output a first bias current ($I_{Bias}$). In some examples, controller 40B may include current source 52 which may be configured to output a second bias current ($I_{Bias}$). In some examples, the first bias current output by current source 50 may be equivalent to the second current output by current source 52. In some examples, the first bias current output by current source 50 may be not equivalent to the second current output by current source 52.

In some examples, controller 40B may include transistor 54 which may be configured to control a current. For instance, in an "on" state, transistor 54 may be configured to allow current to flow to a node between resistor 48 and transistor 46. In some examples, controller 40B may include transistor 56 which may be configured to control a current. For instance, in an "on" state, transistor 56 may be configured to allow current to flow to a node between resistor 48 and power supply 12. In some examples, such as were transistor 54 and transistor 56 are bipolar junction transistors (BJTs), transistor 56 may have a larger emitter area than transistor 54. As one example, transistor 56 may have an emitter area that is 2×, 4×, 6×, 8× the emitter area of transistor 54. As another example, transistor 56 may include multiple transistors with a combined emitter area that is 2×, 4×, 6×, 8× the emitter area of transistor 54. In this way, transistor 54 and transistor 56 may generate an inherent offset which may be referred to as delta $V_{be}$. In some examples, such as were transistor 54 and transistor 56 are metal-oxide semiconductor field effect transistor (MOSFETs), a width to length ratio (W/L) of transistor 56 may be larger than a W/L ratio of transistor 54. In this way, transistor 54 and transistor 56 may generate an inherent offset which may be referred to as delta $V_{gs}$.

In accordance with one or more techniques of this disclosure, device 4C may limit the amount of current provided to load 14 based at least in part on a temperature value. At a first time, in response to receiving a signal, via input 44, driver 42 may output a signal to power supply 12 that causes power supply 12 to provide current to load 14. Upon beginning to receive power from power supply 12, load 14 may become energized and draw an inrush amount of current. In some examples, such as where load 14 includes one or more light emitting devices, the inrush amount of current may be greater than an amount of current drawn by load 14 in a steady state. Additionally, as a result of providing power to load 14, the temperature of power supply 12 may begin to increase.

Temperature sensor 18B of temperature module 6B may output a signal to threshold current module 8B that corresponds to the temperature of power supply 12. Threshold current module 8B may receive the signal, determine a threshold current (i.e., $I_{Temp}$) based on the signal, and output the determined threshold current to current control module 10B.

Current control module 10B may receive the threshold current from threshold current module 8B and, based on the threshold current, adjust the amount of current flowing to load 14. For instance, the current $I_{Temp}$ may be subtracted from the current output by current source 50 (e.g., $I_{Bias}$) such that the current flowing through transistor 54 may be reduced by the amount of $I_{Temp}$. As a result the collector current of transistor 54 is reduced that, in turn, may cause a reduction in the voltage drop across transistor 54. Additionally, the inherent offset (e.g., delta $V_{be}$) of the transistor pair (i.e., transistor 54 and transistor 56) may also be reduced such that, as the value of $I_{Temp}$ increases, the current level at which controller 40B limits or trips the current flowing to load 14 decreases. In other words, as the value of $I_{Temp}$ increases, the current detection is activated at lower currents through load 14.

Figure 5:
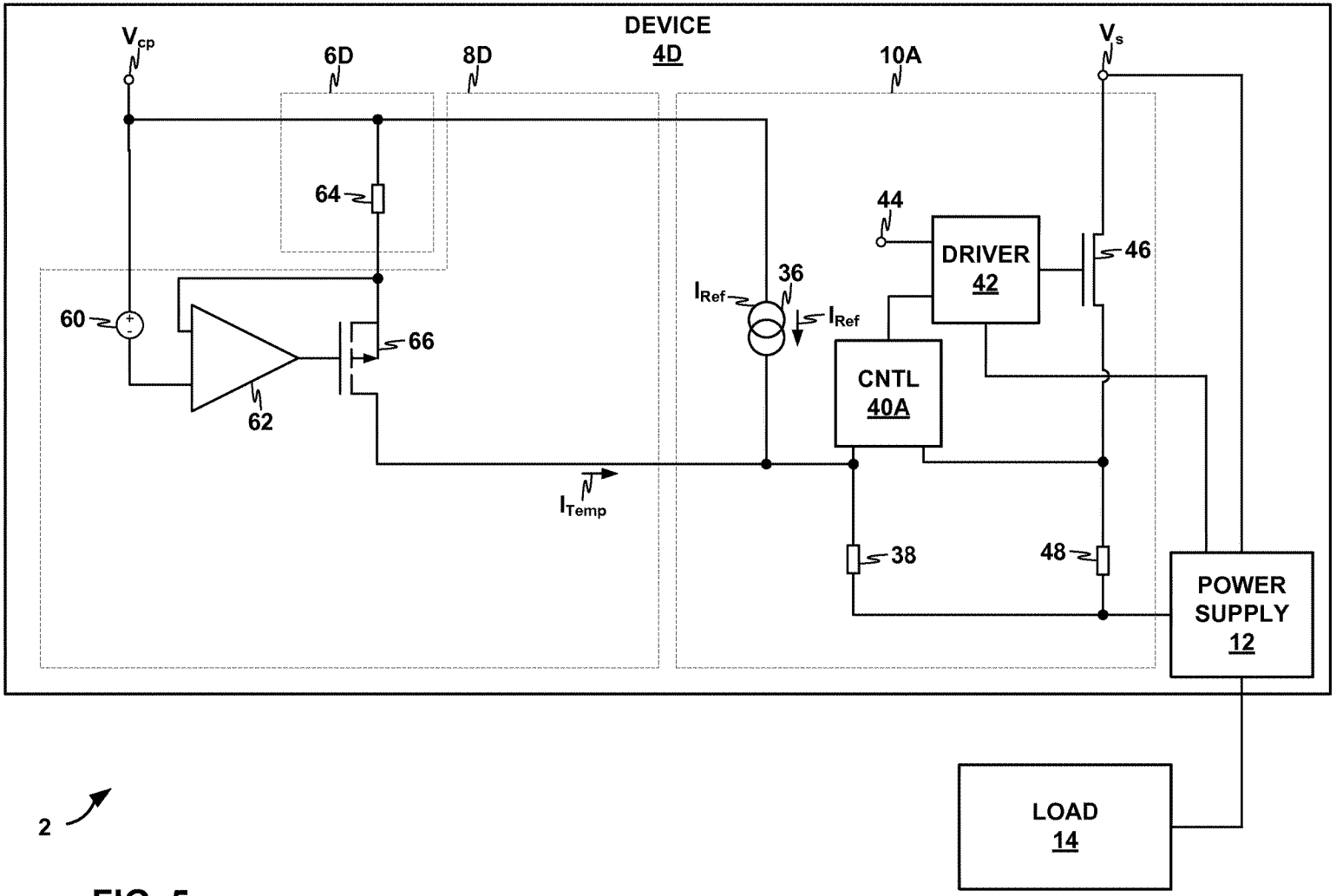
FIG. 5 is a block diagram of another example system that can limit the amount of current provided to a load, in accordance with one or more techniques of this disclosure.

FIG. 5 is a block diagram illustrating details of another example system that can limit the amount of current provided to a load, in accordance with one or more techniques of this disclosure. As illustrated in the example of FIG. 5, may include device 4D and load 14. Device 4D, as illustrated in the example of FIG. 5, may include temperature module 6D, threshold current module 8D, current control module 10A, and power supply 12.

Temperature module 6D may be configured to perform operations similar to temperature module 6 of FIG. 1. For instance, temperature module 6D may be configured to determine a temperature of one or more components of device 4D. As illustrated in the example of FIG. 5, temperature module 6D includes temperature sensor 64 which may be configured to measure the temperature of power supply 12. As discussed above, temperature module 6D may have either a NTC or a PTC. As such, temperature sensor 64 may have either a NTC or a PTC. In some examples, the voltage drop across temperature sensor 64 may correspond to the temperature of power supply 12.

Threshold current module 8D may be configured to perform operations similar to threshold current module 8 of FIG. 1. For instance, threshold current module 8D may be configured to determine, based at least on the temperature received from temperature module 6D, a threshold current. As illustrated in FIG. 5, threshold current module 8D may include voltage source 60, amplifier 62, and transistor 66.

Threshold current module 8D may include voltage source 60 which may be configured to output a voltage signal. In some examples, voltage source 60 may be a bandgap voltage reference that may be configured to output a constant voltage level independent of operating temperature. Voltage source 60 may be configured to output the voltage signal to one or more other components of device 4D, such as amplifier 62.

Threshold current module 8D may include amplifier 62 which, along with transistor 66, may be configured to determine a current as a function of two input signals. For instance, amplifier 62 and transistor 66 may regulate a current as a function of the voltage received from voltage source 60 the voltage signal received from temperature module 6D.

Current control module 10A may be configured to perform operations similar to current control module 10A of FIGS. 1-3. For instance, control current module 10A may be configured to control the amount of current provided to load 14.

Power supply 12 may be configured to perform operations similar to power supply 12 of FIGS. 1-4. For instance, power supply 12 may be configured to provide power to load 14 (e.g., based on a signal received from driver 42 of current control module 10A).

In accordance with one or more techniques of this disclosure, device 4D may limit the amount of current provided to load 14 based at least in part on a temperature value. At a first time, in response to receiving a signal, via input 44, driver 42 may output a signal to power supply 12 that causes power supply 12 to provide current to load 14. Upon beginning to receive power from power supply 12, load 14 may become energized and draw an inrush amount of current. In some examples, such as where load 14 includes one or more light emitting devices, the inrush amount of current may be greater than an amount of current drawn by load 14 in a steady state. Additionally, as a result of providing power to load 14, the temperature of power supply 12 may begin to increase.

Temperature sensor 64 of temperature module 6D may output a signal to threshold current module 8D that corresponds to the temperature of power supply 12. Threshold current module 8D may receive the signal, determine a threshold current (i.e., $I_{Temp}$) based on the signal, and output the determined threshold current to current control module 10A.

Current control module 10A may receive the threshold current from threshold current module 8D and, based on the threshold current, adjust the amount of current flowing to load 14. Further details of the operation of current control module 10A are provided above with reference to FIGS. 1-4.

Figure 6:
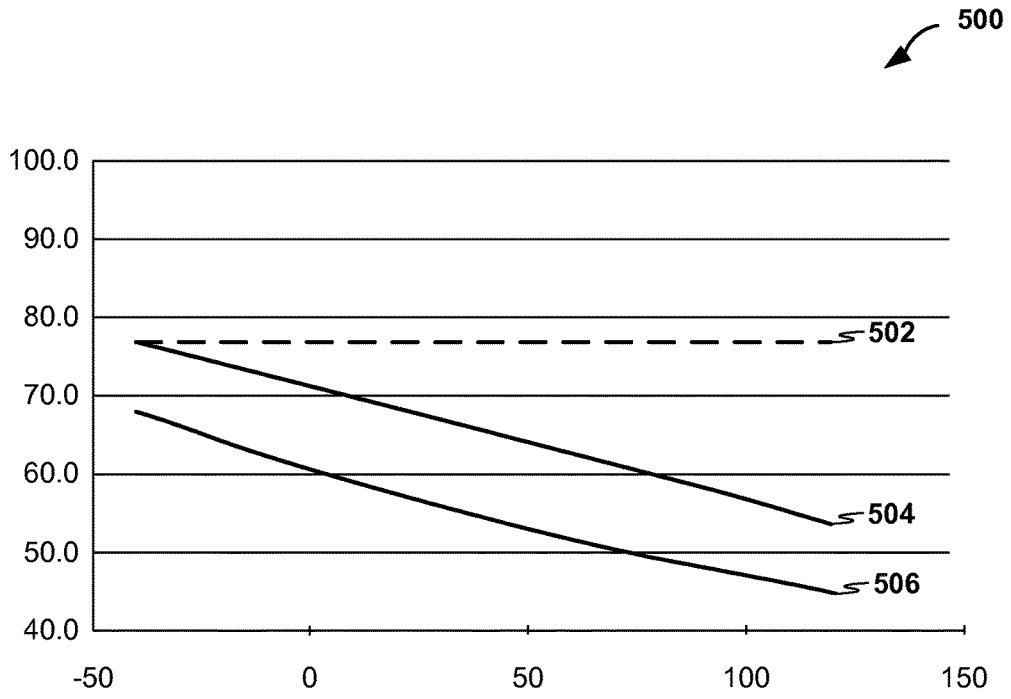
FIG. 6 is a graph illustrating exemplary signals of an example system that limits the amount of current provided to a load, in accordance with one or more techniques of this disclosure.

FIG. 6 is a graph illustrating exemplary signals of an example system that limits the amount of current provided to a load, in accordance with one or more techniques of this disclosure. As illustrated in FIG. 6, graph 500 may include a horizontal axis representing temperature, plot 502 illustrating a first current signal, plot 504 illustrating a second current signal, and plot 506 illustrating a third current signal. In some examples, the first current signal may represent a threshold current that is not a function of temperature. In some examples, the second current signal may be a threshold current determined based on a temperature, such as the threshold current determined by threshold current module 8 of FIG. 1, threshold current module 8A of FIG. 2, threshold current module 8B of FIGS. 3-4, and/or threshold current module 8D of FIG. 5. In some examples, the third current signal may be the amount of current provided by a power supply to a load, such as the amount of current provided by power supply 12 of device 4 to load 14 of FIGS. 1-5.

Figure 7A:
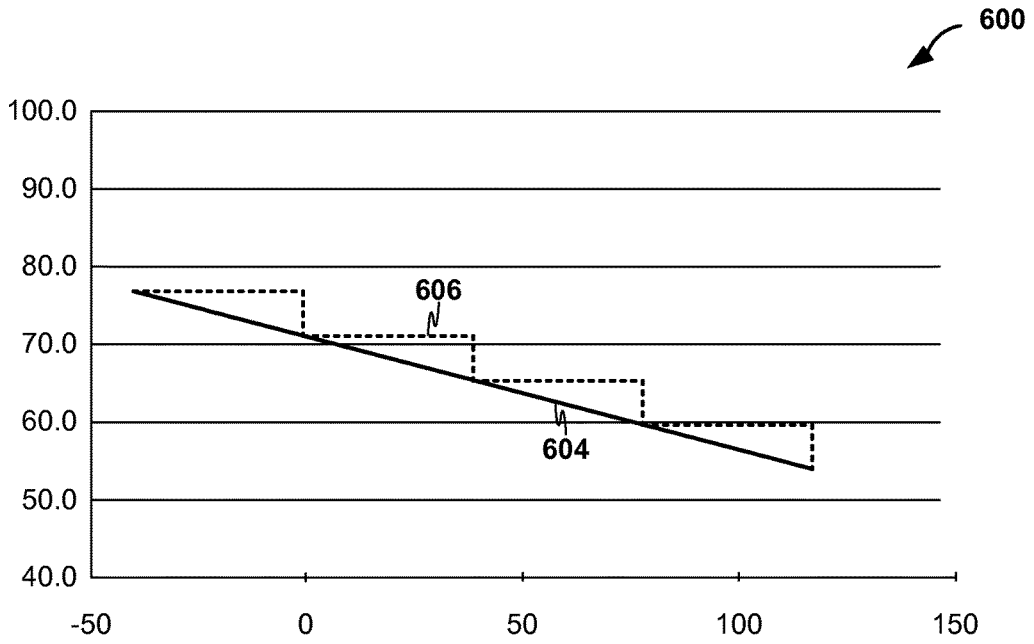
FIGS. 7A-7B are graphs illustrating exemplary signals of an example system that limits the amount of current provided to a load, in accordance with one or more techniques of this disclosure.
Figure 7B:
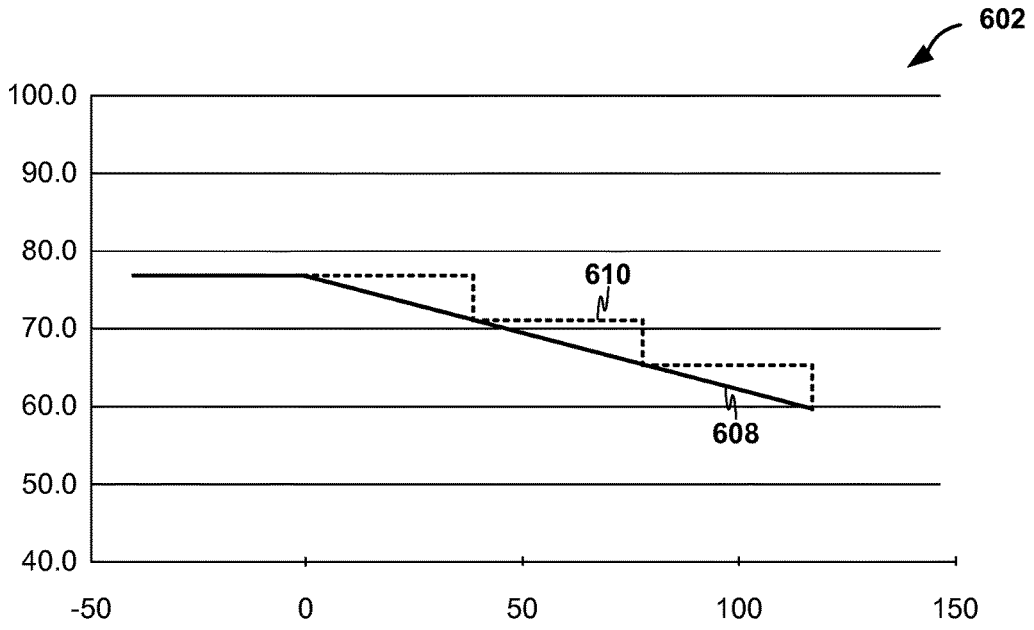

FIGS. 7A-7B are graphs illustrating exemplary signals of an example system that limits the amount of current provided to a load, in accordance with one or more techniques of this disclosure. As illustrated in FIG. 7A, graph 600 may include a horizontal axis representing temperature, plot 604 illustrating a first current signal, and plot 606 illustrating a second current signal. In some examples, the first current signal may be a threshold current determined based on a temperature, such as the threshold current determined by threshold current module 8 of FIG. 1, threshold current module 8A of FIG. 2, threshold current module 8B of FIGS. 3-4, and/or threshold current module 8D of FIG. 5. In some examples, the second current signal may be a threshold current determined based on a temperature, such as the threshold current determined by threshold current module 8 of FIG. 1, threshold current module 8A of FIG. 2, threshold current module 8B of FIGS. 3-4, and/or threshold current module 8D of FIG. 5. As illustrated by the first current signal, in some examples, the threshold current may be determined as a continuous function of temperature. For instance, the second current signal may be determined by an analog implementation of threshold current module 8. As illustrated by the second current signal, in some examples, the threshold current may be determined as a stepped function of temperature. For instance, the second current signal may be determined by a digital implementation of threshold current module 8.

Figure 8:
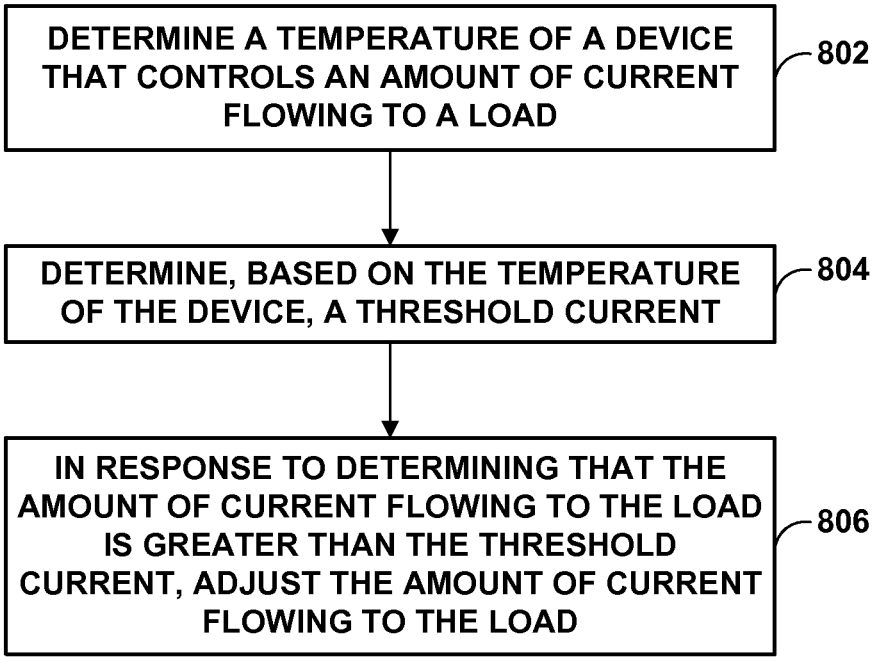
FIG. 8 is a flowchart illustrating exemplary operations of an example system that limits the amount of current provided to a load, in accordance with one or more techniques of this disclosure.

FIG. 8 is a flowchart illustrating exemplary operations of an example system that limits the amount of current provided to a load, in accordance with one or more techniques of this disclosure. For purposes of illustration only, the example operations are described below within the context of device 4 as shown in FIG. 1, devices 4A-4D as respectively shown in FIGS. 2-5.

In accordance with one or more techniques of this disclosure, temperature module 6 of device 4 may determine a temperature of a device, such as power supply 12, that controls an amount of current flowing to a load, such as load 14 (802). As discussed above, temperature module 6 may output a voltage signal that corresponds to the measured temperature. For instance, temperature sensor 18A of temperature module 6A may determine the temperature of power supply 12 of FIG. 2 and output the corresponding voltage signal to amplifier 22A of threshold current module 8A.

Threshold current module 8 may determine, based on the determined temperature of the device, a threshold current (804). As discussed above, threshold current module 8 may determine the threshold current by converting the voltage signal received from temperature module 6 into a current signal (e.g., $I_{Temp}$). For instance, amplifier 22A, resistor 24A, and transistor 26A threshold current module 8A of device 4A may convert a voltage signal received from temperature module 6A into a current signal. In some examples, device 4 may include one or more current mirrors configured to mirror the converted current signal. For instance, in the example of FIG. 2, device 4A includes first current mirror 27A and second current mirror 31A. As another example, in the example of FIG. 3, device 4B includes first current mirror 27B and third current mirror 51.

In response to determining that the amount of current flowing to the load is greater than the threshold current, current control module 10 may adjust the amount of current flowing to the load (806). As discussed above, controller 40 of current control module 10 may compare a first voltage that corresponds to the current flowing to load 14 (i.e., the voltage across resistor 48) to a second voltage that corresponds to the threshold current (i.e., the voltage across resistor 38) to determine whether or not the amount of current flowing to the load is greater than the threshold current.

EXAMPLE 1

A method comprising: determining, by a temperature sensor, a temperature of a device that controls an amount of current flowing to a load; determining, based on the temperature of the device, a threshold current; and in response to determining that the amount of current flowing to the load is greater than the threshold current, adjusting the amount of current flowing to the load.

EXAMPLE 2

The method of example 1, wherein adjusting the amount of current flowing to the load comprises: limiting the amount of current flowing to the load to the threshold current.

EXAMPLE 3

The method of any combination of examples 1-2, wherein adjusting the amount of current flowing to the load comprises: deactivating the load.

EXAMPLE 4

The method of any combination of examples 1-3, wherein the temperature sensor is a first temperature sensor, the method further comprising: determining, by a second temperature sensor, an ambient temperature, wherein determining the threshold current comprises: determining, based on the temperature of the device and the ambient temperature, the threshold current.

EXAMPLE 5

The method of any combination of examples 1-4, wherein determining the temperature of the device comprises: biasing a semiconductor device with a constant current such that a resulting voltage drop across the semiconductor device corresponds to the temperature of the device, wherein the semiconductor device is a bipolar transistor, a resistor, or a diode, and wherein determining the threshold current comprises: determining, based on the resulting voltage drop, an intermediate threshold current; and mirroring, by one or more current mirrors, the intermediate threshold current to generate the threshold current.

EXAMPLE 6

The method of any combination of examples 1-5, wherein determining the threshold current comprises: determining, based on the threshold current and a temperature threshold, the threshold current such that the amount of current flowing to the load is not adjusted if the temperature of the device is less than the temperature threshold.

EXAMPLE 7

The method of any combination of examples 1-6, wherein determining, based on the threshold current and a temperature threshold, the threshold current comprises: determining based on the temperature of the device, an intermediate threshold current; and subtracting a starting current from the intermediate threshold current to determine the threshold current, wherein the starting current is based on the temperature threshold.

EXAMPLE 8

The method of any combination of examples 1-7, wherein upon activation of the load, the amount of current flowing to the load reaches a maximum value at a first time, wherein the temperature of the device reaches a maximum value at a second time, and wherein the second time is later than the first time.

EXAMPLE 9

The method of any combination of examples 1-8, wherein the device is a power transistor.

EXAMPLE 10

A system comprising: a device configured to control an amount of current flowing to a load; a temperature module configured to determine a temperature of the device; a threshold current module configured to determine, based on the temperature of the device, a threshold current; and a current control module configured to adjust the amount of current flowing to the load responsive to determining that the amount of current flowing to the load is greater than the threshold current.

EXAMPLE 11

The system of example 10, wherein adjusting the amount of current flowing to the load comprises: limiting the amount of current flowing to the load to the threshold current.

EXAMPLE 12

The system of any combination of examples 10-11, wherein the current control module is configured to adjust the amount of current flowing to the load by at least: deactivating the load.

EXAMPLE 13

The system of any combination of examples 10-12, wherein the temperature module is a first temperature module, the system further comprising: a second temperature module configured to determine an ambient temperature, wherein the threshold current module is configured to determine the threshold current by at least: determining, based on the temperature of the device and the ambient temperature, the threshold current.

EXAMPLE 14

The system of any combination of examples 10-13, wherein the temperature module includes: a semiconductor device biased with a constant current such that a resulting voltage drop across the semiconductor device corresponds to the temperature of the device, wherein the semiconductor device is a bipolar transistor, a resistor, or a diode, and wherein the threshold current module is configured to determine the threshold current by at least: determining, based on the resulting voltage drop, an intermediate threshold current; and mirroring, by one or more current mirrors of the threshold current module, the intermediate threshold current to generate the threshold current.

EXAMPLE 15

The system of any combination of examples 10-14, wherein the threshold current module is configured to determine the threshold current by at least: determining, based on the threshold current and a temperature threshold, the threshold current such that the current control modules does not adjust amount of current flowing to the load if the temperature of the device is less than the temperature threshold.

EXAMPLE 16

The system of any combination of examples 10-15, wherein the threshold current module is configured to determine the threshold current by at least: determining based on the temperature of the device, an intermediate threshold current; and subtracting a starting current from the intermediate threshold current to determine the threshold current, wherein the starting current is based on the temperature threshold.

EXAMPLE 17

The system of any combination of examples 10-16, wherein upon activation of the load, the amount of current flowing to the load reaches a maximum value at a first time, wherein the temperature of the device reaches a maximum value at a second time, and wherein the second time is later than the first time.

EXAMPLE 18

The system of any combination of examples 10-17, wherein the device is a power transistor.

EXAMPLE 19

A system comprising: means for controlling an amount of current flowing to a load; means for determining a temperature of the means for controlling; means for determining, based on the temperature of the means for controlling, a threshold current; and means for adjusting the amount of current flowing to the load responsive to determining that the amount of current flowing to the load is greater than the threshold current.

EXAMPLE 20

The system of example 19, wherein the means for adjusting comprise means for deactivating the load.

EXAMPLE 21

The system of example 19, further comprising means for performing any combination of the methods of examples 1-9.

The techniques described in this disclosure may be implemented, at least in part, in hardware, software, firmware, or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Such hardware, software, and firmware may be implemented within the same device or within separate devices to support the various techniques described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware, firmware, or software components. Rather, functionality associated with one or more modules or units may be performed by separate hardware, firmware, or software components, or integrated within common or separate hardware, firmware, or software components.

The techniques described in this disclosure may also be embodied or encoded in an article of manufacture including a computer-readable storage medium encoded with instructions. Instructions embedded or encoded in an article of manufacture including a computer-readable storage medium encoded, may cause one or more programmable processors, or other processors, to implement one or more of the techniques described herein, such as when instructions included or encoded in the computer-readable storage medium are executed by the one or more processors. Computer readable storage media may include random access memory (RAM), read only memory (ROM), programmable read only memory (PROM), erasable programmable read only memory (EPROM), electronically erasable programmable read only memory (EEPROM), flash memory, a hard disk, a compact disc ROM (CD-ROM), a floppy disk, a cassette, magnetic media, optical media, or other computer readable media. In some examples, an article of manufacture may include one or more computer-readable storage media.

In some examples, a computer-readable storage medium may include a non-transitory medium. The term "non-transitory" may indicate that the storage medium is not embodied in a carrier wave or a propagated signal. In certain examples, a non-transitory storage medium may store data that can, over time, change (e.g., in RAM or cache).

Various aspects have been described in this disclosure. These and other aspects are within the scope of the following claims.

The invention claimed is:

1. A method comprising:

providing, by a device, an amount of current to a load;

measuring, by a temperature sensor, a temperature of the device;

adjusting, based on the temperature of the device, a current trip threshold that is greater than zero such that the current trip threshold decreases as the temperature of the device increases; and in response to determining that the amount of current flowing to the load is greater than the current trip threshold, deactivating the load.

2. The method of claim 1, wherein the temperature sensor is a first temperature sensor, the method further comprising:

determining, by a second temperature sensor, an ambient temperature, wherein determining the current trip threshold comprises:

determining, based on the temperature of the device and the ambient temperature, the current trip threshold.

3. The method of claim 1, wherein determining the temperature of the device comprises:

biasing a semiconductor device with a constant current such that a resulting voltage drop across the semiconductor device corresponds to the temperature of the device, wherein the semiconductor device is a bipolar transistor, a resistor, or a diode, and wherein determining the current trip threshold comprises:

determining, based on the resulting voltage drop, an intermediate current trip threshold; and mirroring, by one or more current mirrors, the intermediate current trip threshold to generate the current trip threshold.

4. The method of claim 1, wherein determining the current trip threshold comprises:

determining, based on the current trip threshold and a temperature threshold, the current trip threshold such that the load is not deactivated if the temperature of the device is less than the temperature threshold.

5. The method of claim 4, wherein determining, based on the current trip threshold and a temperature threshold, the current trip threshold comprises:

determining based on the temperature of the device, an intermediate current trip threshold; and subtracting a starting current from the intermediate current trip threshold to determine the current trip threshold, wherein the starting current is based on the temperature threshold.

6. The method of claim 1, wherein upon activation of the load, the amount of current flowing to the load reaches a maximum value at a first time, wherein the temperature of the device reaches a maximum value at a second time, and wherein the second time is later than the first time.

7. The method of claim 1, wherein the device is selected from the group consisting of a power transistor, a thyristor, an insulated-gate bipolar transistor (IGBT), and a metal-oxide-semiconductor field-effect transistor (MOSFET).

8. A system comprising:

a device configured to provide an amount of current to a load;

a temperature module configured to determine a temperature of the device;

a current threshold module configured to determine, based on the temperature of the device, a current trip threshold that is greater than zero, wherein the current trip threshold decreases as the temperature of the device increases; and a current control module configured to, responsive to determining that the amount of current flowing to the load is greater than the current trip threshold deactivate the load.

9. The system of claim 8, wherein the temperature module is a first temperature module, the system further comprising:

a second temperature module configured to determine an ambient temperature, wherein the current threshold module is configured to determine the current trip threshold by at least:

determining, based on the temperature of the device and the ambient temperature, the current trip threshold.

10. The system of claim 8, wherein the temperature module includes:

a semiconductor device biased with a constant current such that a resulting voltage drop across the semiconductor device corresponds to the temperature of the device, wherein the semiconductor device is a bipolar transistor, a resistor, or a diode, and wherein the current threshold module is configured to determine the current trip threshold by at least:

determining, based on the resulting voltage drop, an intermediate current trip threshold; and mirroring, by one or more current mirrors of the current threshold module, the intermediate current trip threshold to generate the current trip threshold.

11. The system of claim 8, wherein the current threshold module is configured to determine the current trip threshold by at least:

determining, based on the current trip threshold and a temperature threshold, the current trip threshold such that the current control modules does not deactivate the load if the temperature of the device is less than the temperature threshold.

12. The system of claim 11, wherein the current threshold module is configured to determine the current trip threshold by at least:

determining based on the temperature of the device, an intermediate current trip threshold; and subtracting a starting current from the intermediate current trip threshold to determine the current trip threshold, wherein the starting current is based on the temperature threshold.

13. The system of claim 8, wherein upon activation of the load, the amount of current flowing to the load reaches a maximum value at a first time, wherein the temperature of the device reaches a maximum value at a second time, and wherein the second time is later than the first time.

14. The system of claim 8, wherein the device is selected from the group consisting of a power transistor, a thyristor, an insulated-gate bipolar transistor (IGBT), and a metal-oxide-semiconductor field-effect transistor (MOSFET).

15. A system comprising:

means for providing an amount of current to a load;

means for determining a temperature of the means for providing;

means for determining, based on the temperature of the means for providing, a current trip threshold that is greater than zero, wherein the current trip threshold decreases as the temperature of the device increases; and means for, responsive to determining that the amount of current flowing to the load is greater than the current trip threshold deactivating the load.

* * * * *